US005976630A

United States Patent [19]

Korokeyi et al.

[11] Patent Number: 5,976,630

[45] Date of Patent: Nov. 2, 1999

[54] METHOD AND APPARATUS FOR CURTAIN COATING

[75] Inventors: Solomon T. Korokeyi; Kenneth J. Ruschak, both of Rochester; Kurt S. Hardenbrook, Hamlin; Douglas S. Finnicum, Webster; Robert J. Deprez, Avon, all of N.Y.

[73] Assignee: Eastman Kodak Company, Rochester, N.Y.

[21] Appl. No.: 08/939,617

[22] Filed: Sep. 29, 1997

[51] Int. Cl.[6] ..... B05D 1/30; B05C 1/00

[52] U.S. Cl. ..... 427/420; 118/325; 118/DIG. 4

[58] Field of Search ..... 118/DIG. 4, 325, 118/410, 413, 419; 427/420, 421; 55/204

[56] References Cited

U.S. PATENT DOCUMENTS

| | | | |
|---|---|---|---|
| 3,508,947 | 4/1970 | Hughes | 117/34 |
| 3,867,901 | 2/1975 | Greiller | 118/50 |
| 4,143,190 | 3/1979 | Choinski | 427/420 |
| 4,287,240 | 9/1981 | O'Connor | 427/402 |
| 4,290,791 | 9/1981 | Matsui et al. | 55/204 |
| 4,443,504 | 4/1984 | Burket et al. | 427/445 |
| 4,643,746 | 2/1987 | Suzuki et al. | 55/204 |
| 5,065,675 | 11/1991 | Tapper | 101/153 |
| 5,143,758 | 9/1992 | Devine | 427/420 |
| 5,181,963 | 1/1993 | Degrauwe et al. | 118/325 |
| 5,224,996 | 7/1993 | Ghys et al | 118/325 |
| 5,436,030 | 7/1995 | Damrau | 118/DIG. 4 |
| 5,624,715 | 4/1997 | Gueggi et al. | 427/420 |

OTHER PUBLICATIONS

Douglas Finnicum, Steven Weinstein and Kenneth Ruschak, J. Fluid Mech. (1983), vol. 255, "The effect of applied pressure on the shape of a two–dimensional liquid curtain falling under the influence of gravity", pp. 647–665.

*Primary Examiner*—David A. Simmons
*Assistant Examiner*—Calvin Padgett
*Attorney, Agent, or Firm*—Mark G. Bocchetti

[57] ABSTRACT

A method and apparatus for preventing vortical air flow behind a free-falling curtain in a curtain coating apparatus. There is a critical region within the coating apparatus defined in part by a coating hopper, the free-falling curtain delivered from the coating hopper, a portion of the moving substrate supported on a roller to which the free-falling curtain is delivered, and an air shield located between the roller and the coating hopper. A first intake slot proximate to the moving substrate shield is used to remove boundary-layer air entrained on the moving substrate. A second intake slot positioned within the critical region is used to remove boundary-layer air entrained on the free-falling curtain. Each of the two intake slots is connected to vacuum source. One or two vacuum sources may be used.

23 Claims, 6 Drawing Sheets

METHOD AND APPARATUS FOR CURTAIN COATING

FIELD OF THE INVENTION

This invention relates generally to curtain coating in a continuously moving substrate with a plurality of simultaneously applied layers of liquid coating materials and, more particularly, to curtain coating in the manufacture of photographic elements with reduced susceptibility to the formation of streaks.

BACKGROUND OF THE INVENTION

In slide hopper curtain coating operations, the liquid to be coated onto a moving substrate issues from the hopper slot and flows down the slide to the hopper lip. As the liquid exits the hopper lip, there is formed a generally planar liquid sheet or curtain which falls freely by the action of gravity. This resulting curtain is deposited on the moving substrate at a point of impingement or, more accurately, a line of impingement. The action of the moving web substrate or web induces a flow of air forming a boundary layer. The detrimental effect of boundary-layer air resulting from the movement of the web is known. Also known are methods for mitigating the detrimental effect of boundary-layer air. One approach was taught in U.S. Pat. No. 3,508,947 to Hughes in which the air entrained on the moving web is minimized by the use of an air shield that has been provided with a vacuum manifold which is positioned adjacent the web to be coated and connected to a vacuum pump to withdraw air therefrom. In this manner, Hughes proposes that the multilayer, free-falling vertical curtain is shielded from ambient air currents and the air entrained by the moving web is drawn off before the curtain impinges on the moving web.

More recent curtain coating practice employs the air shield mainly for the purpose of drawing off air entrained by the moving web as opposed to shielding the free-falling curtain from ambient air currents. This is because curtain coating operations now typically include an enclosure to shield the free-falling liquid curtain from ambient air currents. The enclosure is continuously supplied with laminar low velocity air flow from the top while, at the same time, air is exhausted from both the front and rear of the enclosure. It is known that air shield systems employing a single manifold and a single vacuum source have been operated to exhaust higher air volumes in an attempt to remove additional air from behind the free-falling curtain as well as air entrained on the web.

A similar approach to minimizing the detrimental effect of boundary-layer air of the moving web is taught in U.S. Pat. No. 5,224,996 to Ghys et al. Ghys et al employed an alternative design for a curved air shield arranged in a closely spaced relationship to a backing roller which supports the moving web at the point of impingement. The alternative design for the air shield provides for increased resistance to air flow in the gap between the air shield and the backing roller at the end and side regions thereof as compared to air flow resistance at an intermediate region of the shield. A vacuum device communicates with the gap in the intermediate region to reduce air pressure therein. In such manner, there is improved removal of boundary-layer air at the surface of the moving web prior to the impingement point which apparently allows for increased speed of the moving web.

Although the prior art has dealt with minimizing the effect of boundary-layer air induced by the moving substrate, the prior art has failed to recognize or deal with the removal of entrained or boundary-layer air induced by the free-falling curtain. In fact, no negative impact on product quality in the production of photographic elements has been attributed to boundary-layer air of the free-falling curtain in the past. However, with the increased sensitivity of photographic materials achieved in recent years, product quality has become more susceptible to the detrimental effects of air currents. It has been found that on photographic products with high sensitivity, random or irregular streaks may be produced in the product even though the boundary-layer air caused by the moving web has been nullified.

SUMMARY OF THE INVENTION

It is, therefore, an object of the present invention to provide an improved curtain coating method which reduces air currents affecting the free-falling curtain and thereby limits streaks induced by such air currents.

It is a further object of the present invention to provide an improved curtain coating method which generally removes the entrained boundary-layer air of the free-falling curtain after the point of impingement to prevent recirculation.

Another object of the present invention is to provide an improved curtain coating method which substantially eliminates vortical air flow patterns behind the free-falling curtain.

Briefly stated, these and numerous other features, objects and advantages of the present invention will become readily apparent upon a reading of the detailed description, claims and drawings set forth herein. These features, objects and advantages are accomplished by providing a curtain coating apparatus which includes a coating hopper that delivers a free-falling curtain to a moving substrate supported on a roller with an air shield and means for generating a vacuum to remove boundary-layer air entrained on the moving substrate as well as means for removing boundary-layer air entrained on the free-falling curtain. The same vacuum pump or a separate vacuum pump may be used to remove boundary-layer air from the free-falling curtain. Two separate intake slots are used, one dedicated to removing the entrained boundary-layer air of the moving substrate and one dedicated to the removal of the entrained boundary-layer air of the free-falling curtain. The two intakes are used in combination with an air shield. The combination allows for the removal of the boundary-layer air from both the moving substrate and the free-falling curtain and through control of the amount of spent air removed from behind the free-falling curtain, new air can be supplied to the back of the free-falling curtain without inducing a recirculation or vortical flow pattern in the region bounded by the coating hopper, the free-falling curtain and the air shield.

It has been found that some unsteady streaks in the photographic elements produced with curtain coaters for coating photographic emulsions, polymer melts and solutions, and the like can be traced to a recirculating air flow pattern in the region behind the free-falling curtain. This recirculation or vortex has turbulence characteristics which can amplify random air disturbances. It is these amplified disturbances that induce streaks on the free-falling curtain.

BRIEF DESCRIPTION OF THE DRAWINGS

FIG. 4(*b*) depicts another exemplary air flow pattern behind the free-falling curtain with the apparatus depicted in FIG. 3 reoriented at a different angle.

DETAILED DESCRIPTION OF THE INVENTION

Figure 1:
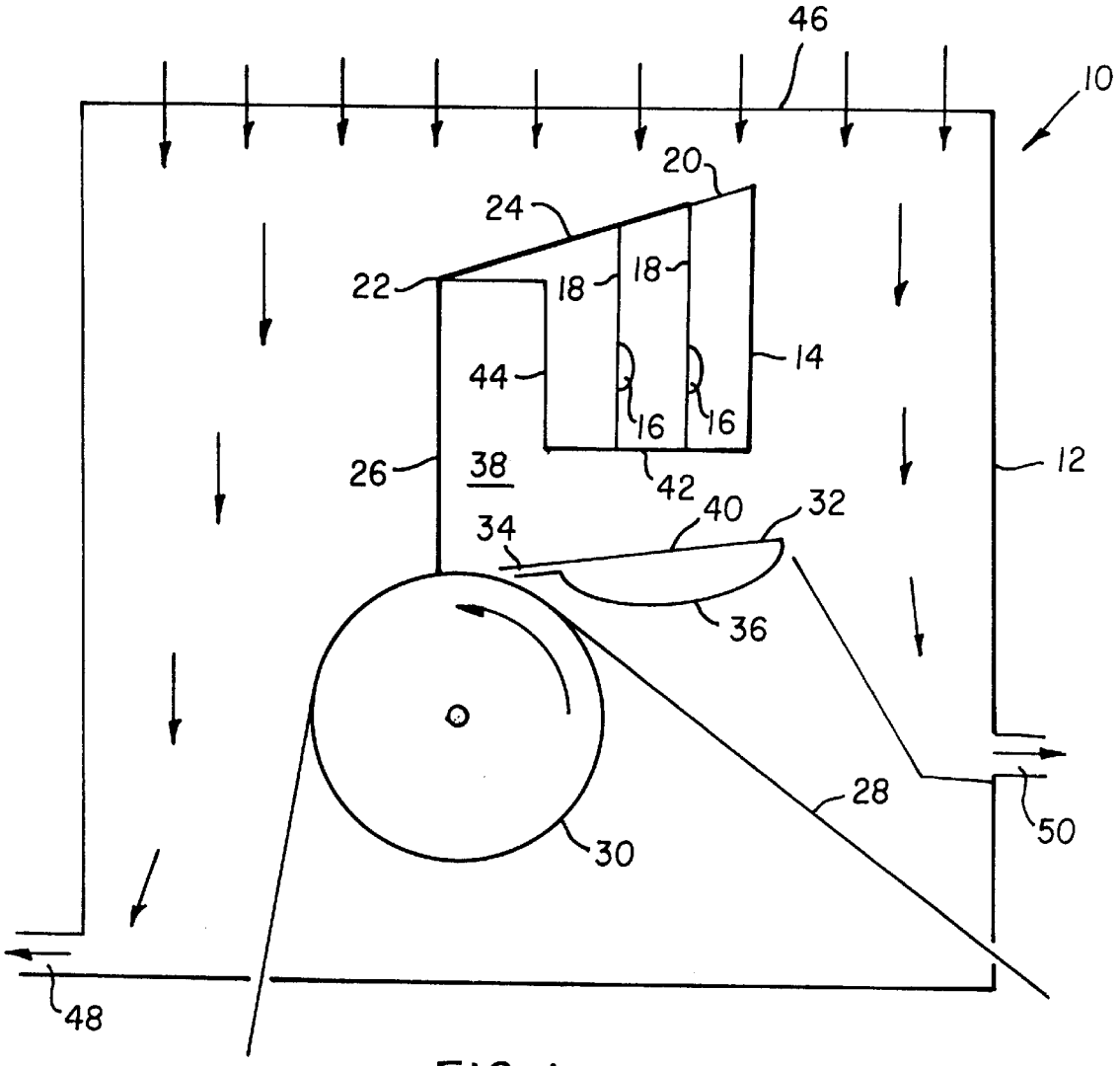
FIG. 1 (prior art)
FIG. 1 is a schematic drawing of a prior art curtain coating apparatus.

Turning first to FIG. 1, there is shown schematically a prior art curtain coating apparatus 10. The coating apparatus 10 includes an enclosure or housing 12. Fresh, filtered, optionally heated, laminar, low velocity air (in the range of from about 10 to about 20 ft/min) is supplied to the enclosure 12 through the upper perforated wall 46 thereof. It is necessary that the free-falling curtain 26 be supplied with fresh air as spent air is withdrawn from the enclosure 12. Spent air is withdrawn from enclosure 12 through exhaust ports 48, 50. Additionally, spent air leaves the enclosure 12 with web 28. The two exhaust ports 48, 50 are necessary to minimize pressure differential across the free-falling curtain 26. Residing within the enclosure 12 is the coating hopper 14. The coating hopper 14 includes at least one distribution chamber 16, each distribution chamber 16 leading to a slot 18. Coating hopper 14 further includes a slide 20 and a lip 22. Liquid photographic coating compositions are fed at a uniform rate by a constant feed pump, not shown, into the distribution chambers 16. The liquid photographic coating compositions then flow vertically upward through slots 18 and out onto slide 20. The layer of liquid 24 so formed on slide 20 flows downward by gravity to exit the slide at lip 22 thereby forming free-falling curtain 26 which is generally a planar liquid sheet. After falling a prescribed height, the curtain 26 impinges on a moving web or substrate 28 as the moving web or substrate 28 passes over and around a supporting roll 30. An air shield 32 is used to restrict or remove air entrained on the moving web 28 thereby preventing the detrimental effects that the boundary-layer air entrained on the web 28 would have on the curtain 26. The air shield 32 includes a slot or intake section 34 and a manifold section 36. The manifold section 36 is connected to a vacuum pump (not shown) through which air can be exhausted. When the vacuum pump is activated, the entrained air on the moving web 28 is drawn through the intake section 34 into the manifold section 36 and exhausted from enclosure 12.

Figure 2:
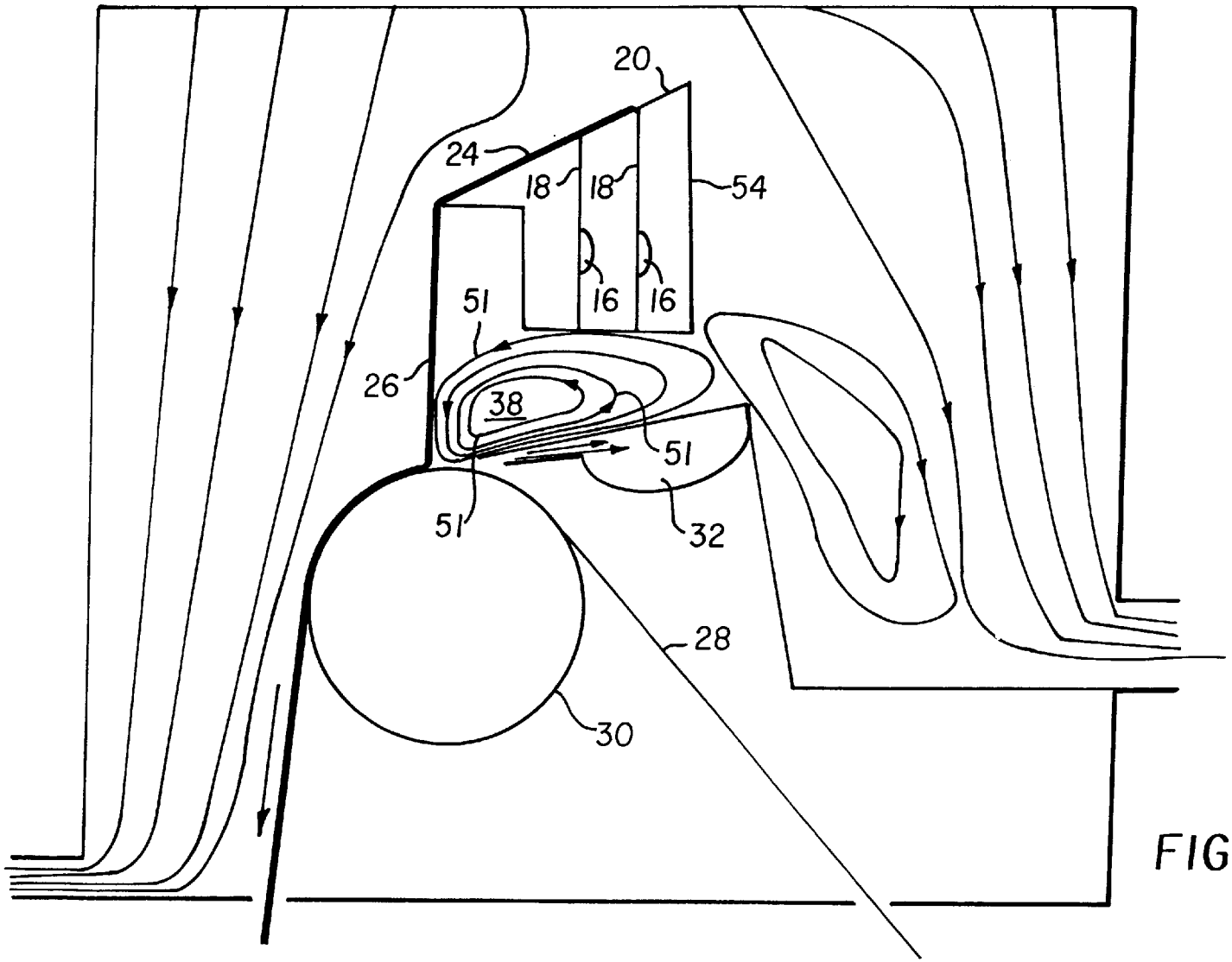
FIG. 2 is a flow diagram depicting air flow behind the free-falling curtain in the curtain coating apparatus of FIG. 1.

There is a critical region 38 bounded by the upper surface 40 of air shield 32, the bottom surface 42 and front surface 44 of coating hopper 14, and the curtain 26. It is in this critical region 38 behind curtain 26 in which a recirculating air pattern or vortex has now been found to exist. FIG. 2 depicts an exemplary air flow pattern within coating apparatus 10 of the prior art. Note the vortical flow pattern indicated by air flow lines 51 created behind curtain 26 in the critical region 38.

Figure 3:
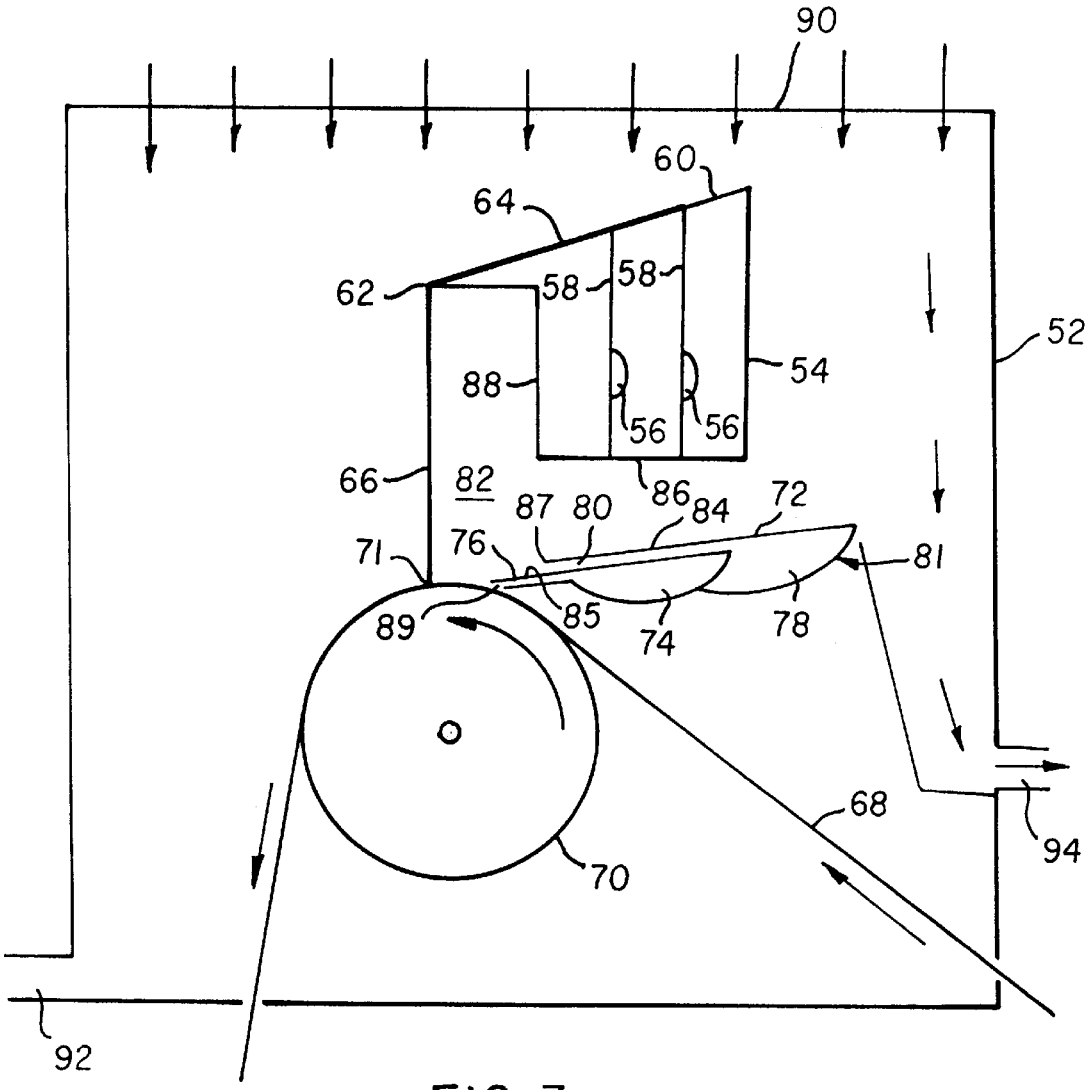
FIG. 3 is a schematic drawing of an improved curtain coating apparatus containing a preferred embodiment of an air flow removal system.
Figure 4B:
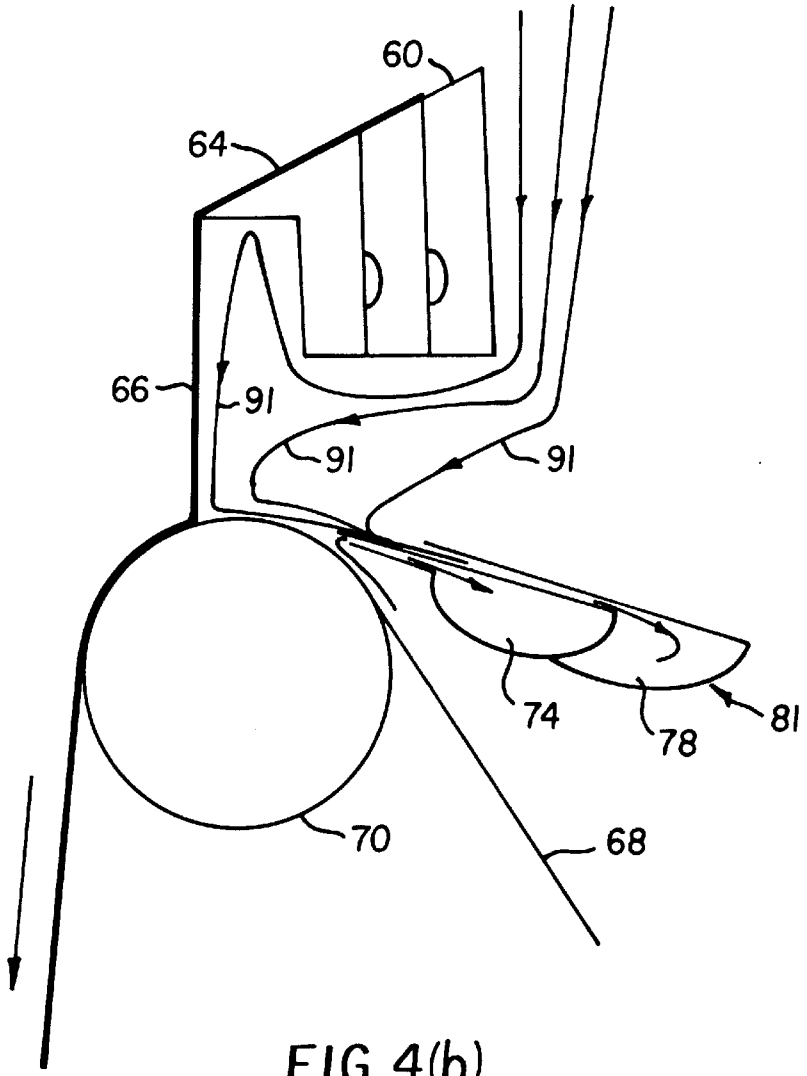
FIG. 4(*a*) depicts an exemplary air flow pattern behind the free-falling curtain of the apparatus depicted in FIG. 3.
Figure 4A:
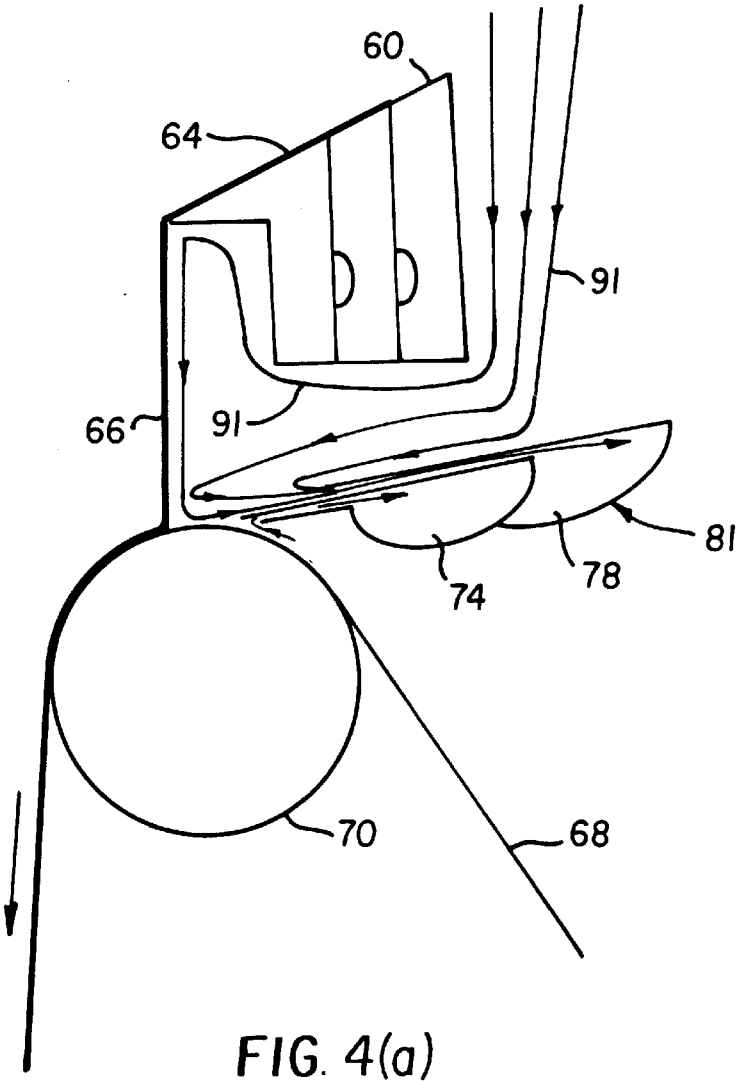

Turning next to FIG. 3, there is shown schematically the preferred embodiment of the present invention. The preferred embodiment includes an enclosure 52. Residing within enclosure 52 is a coating hopper 54. The coating hopper 54 typically includes at least one distribution chamber 56, a slot 58 associated with each distribution chamber 56, a slide 60 and a lip 62. Coating hopper 54 is conventionally operated such that liquid from the at least one distribution chamber 56 rises through slots 58 to form a liquid layer 64 on slide 60. Liquid layer 64, as it exits slide 60 at lip 62 forms a free-falling curtain 66. Free-falling curtain 66 falls to meet the moving web 68 which is supported on a supporting roll 70 at a point of impingement 71. Residing beneath coating hopper 54 is an air removal system. The air removal system is comprised of an air shield 72 which includes a first manifold section 74 having an intake slot 76. First manifold section 74 is connected to a vacuum source (not shown). Air shield 72 further includes a second manifold section 78 with a second intake slot 80. The second manifold section 78 is connected to a second vacuum source (also not shown). There is a critical region 82 bounded by the upper surface 84 of air shield 72, the upper surface 85 of intake slot 76, the bottom surface 86 and front surface 88 of coating hopper 54, the web 68 supported on roller 70, and the free-falling curtain 66. It is in this critical region 82 along the backside of free-falling curtain 66 that a boundary-layer of air is entrained on the free-falling curtain 66. This boundary-layer of air can lead to a recirculation or vortex pattern in the critical region as depicted in FIG. 2. This recirculation or vortex can lead to disturbances in the curtain 66 as explained above which, in turn, can lead to streaks in the product. In addition, the recirculation of spent air may inhibit replenishing air from being supplied to the backside of the free-falling curtain 66. Intake slot 76 again serves to remove the boundary-layer air entrained on the surface of the moving web 68. Intake slot 80 serves to remove boundary-layer air entrained on the backside of free-falling curtain 66 which thereby eliminates the recirculation or vortex pattern which can form in the critical region 82. By connecting first manifold section 74 and second manifold section 78 to two separate vacuum sources, operation of such vacuum sources can be separately controlled, thus, allowing the vacuum pressures at intake slots 76, 80 to be independently controlled. Air shield 72 with first manifold 74 and intake slot 76 are used only for the purpose of removing air entrained on the moving web 68. Second manifold section 78 and second intake slot 80 are used for vortex exhaust with the principal purpose of removing the spent air of the curtain boundary-layer. The tip 87 of the second intake slot 80 should be located within the critical zone 82 and behind the tip 89 of intake slot 76. Thus, tip 87 may reside a minimum distance of about one inch from the free-falling curtain 66 to a maximum distance where tip 87 is aligned with the rear wall of hopper 54. Air flow lines 91 in FIG. 4(*a*) show an exemplary air flow pattern within enclosure 52 with proper operation of the boundary-layer air removal system 81. Air flow lines 93 in FIG. 4(*b*) show an exemplary air flow pattern within enclosure 52 with proper operation of the boundary-layer air removal system 81. The only difference between FIGS. 4(*a*) and 4(*b*) is the orientation of the boundary-layer air removal system 81. Note that the boundary-layer air removal system 81 is not limited to a particular angular orientation in achieving the elimination of vortical flow.

As with the curtain coating apparatus 10 depicted in FIG. 1, the enclosure 52 of the improved curtain coating apparatus of the present invention includes an upper wall 90 as well as a pair of exhaust ports 92, 94. Replenishing air is supplied to enclosure 52 through openings in upper wall 90 preferably by means of a forced air delivery system (not shown).

Figure 5:
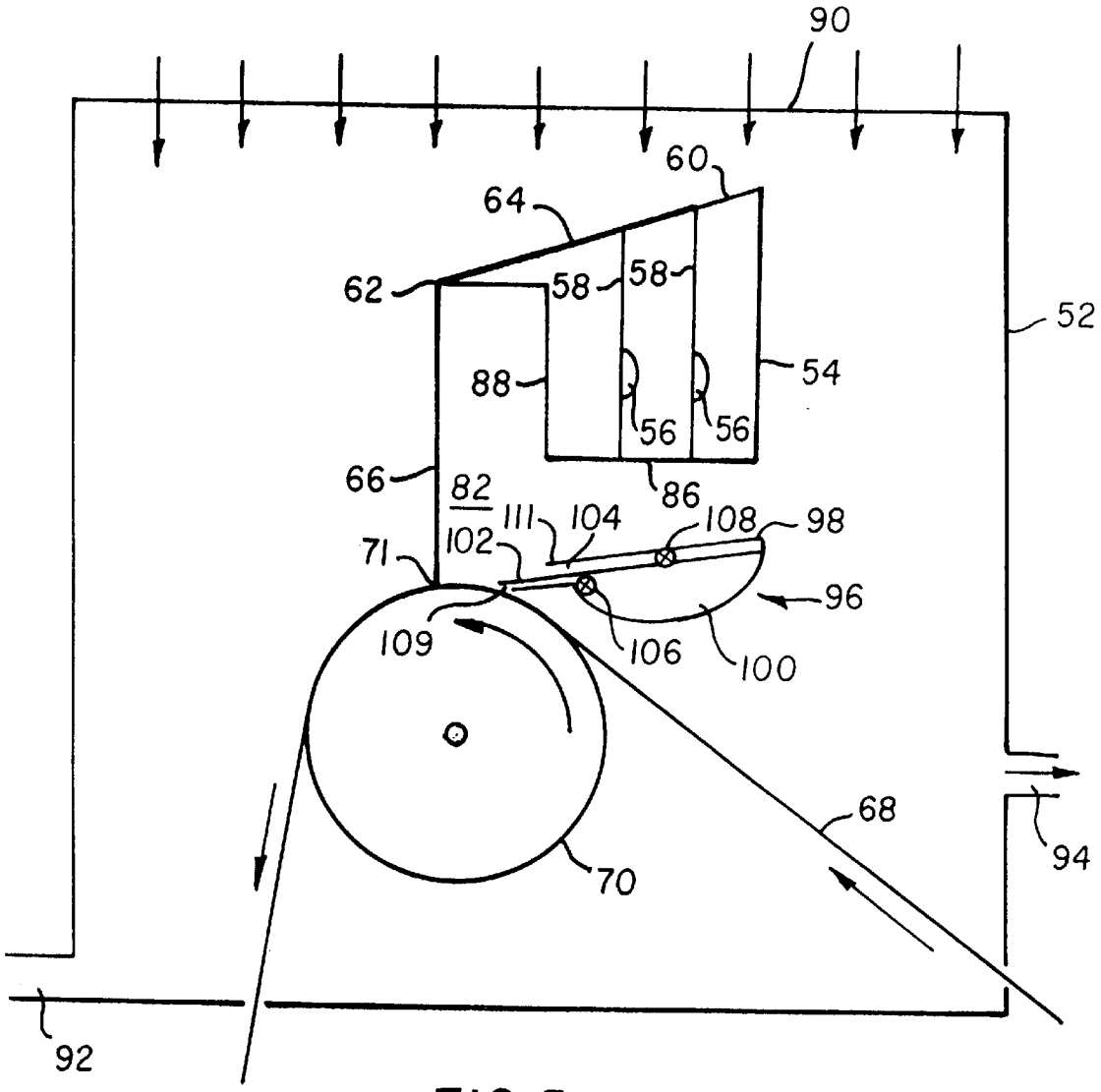
FIG. 5 is a schematic drawing of a curtain coating apparatus containing an alternative embodiment of the air flow removal system depicted in FIG. 3.

Turning next to FIG. 5, there is shown an alternative embodiment of the boundary-layer air removal system of the present invention. This alternative embodiment of the boundary-layer air removal system resides in a curtain coating apparatus identical to the one depicted in FIG. 3. As such, for purposes of simplicity, all of the elements of the curtain coating apparatus shown in FIG. 5 are numbered identically to corresponding elements shown in FIG. 3. The only exception is the alternative embodiment for the boundary-layer air removal system 96. With this alternative embodiment for the boundary-layer air removal system 96, there is an air shield 98 which includes a manifold section 100 and intake slots 102, 104. There is a first control valve 106 connecting manifold 100 with intake slot 102 and there is a second control valve 108 connecting manifold 100 with intake slot 104. Through operation of first and second control valves 106, 108, the amount of air drawn away by vacuum from critical region 82 can be regulated. In such manner, intake slot 104 is used to prevent the formation of a vortex within critical region 82. Additionally, through operation of first control valve 106, air entrained on the moving web 68 is removed. By connecting both intake slots 102, 104 to a single manifold 100, a single vacuum source can be used to exhaust both the boundary-layer of air entrained on the moving web 68 and the boundary-layer of air entrained on the backside of the free-falling curtain 66. Through operation of the control valves 106, 108, the vacuum pressures can be individually set. The positioning of the tips 109, 111 of intake slots 102, 104, respectively, is identical to the positioning of tips 87, 89 as described with regard to FIG. 3.

Figure 6:
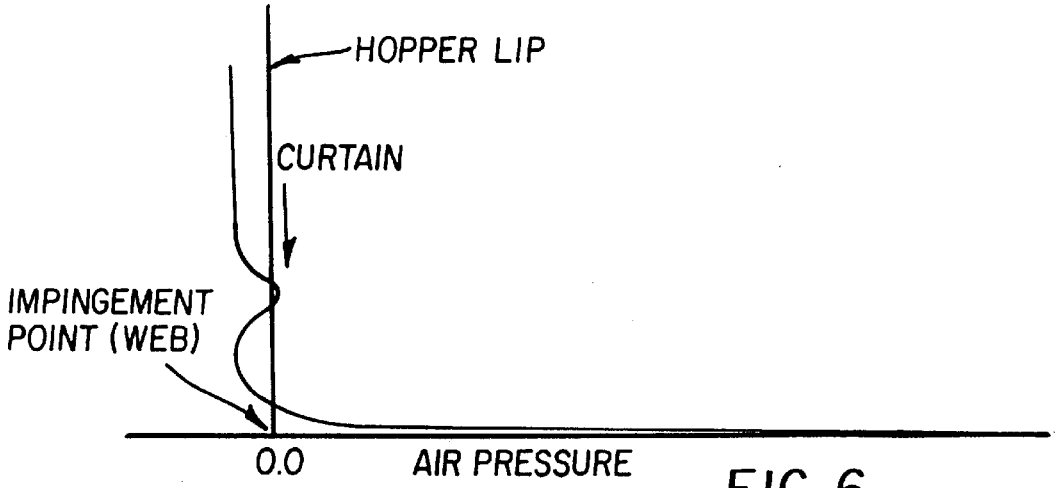
FIG. 6 is a graph showing the profile of the air pressure on the free-falling curtain based upon a computer simulation when a recirculation pattern is present such as, for example, depicted in FIG. 2.
Figure 7:
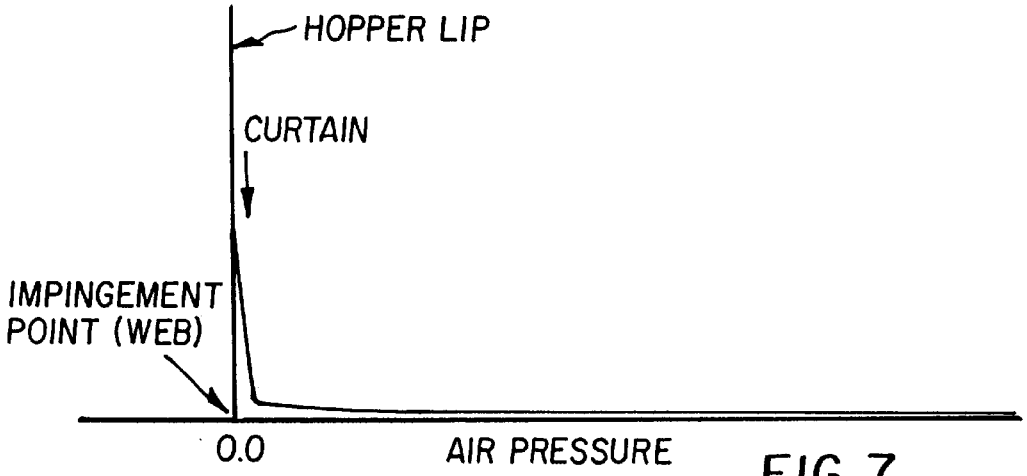
FIG. 7 is a graph showing the air pressure profile on the free-falling curtain based upon a computer simulation when the volume of air being exhausted is beyond the optimal range.
Figure 8:
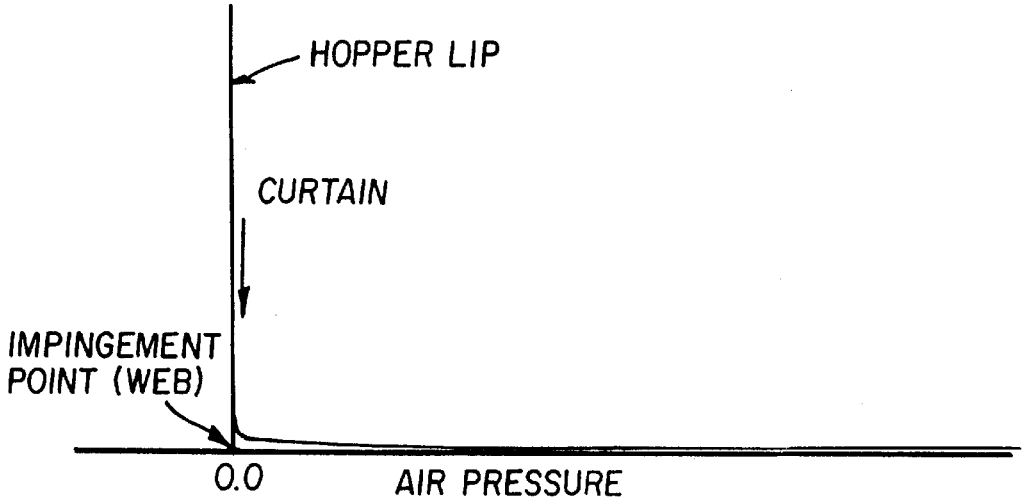
FIG. 8 is a graph showing the profile of air pressure on the free-falling curtain based upon a computer simulation with air being exhausted by the air flow removal system within the optimal range.

In the operation of the boundary-layer air removal systems 81, 96 removal of a fixed volume of air equal to the amount of air entrained by the boundary-layer on the backside of the free-falling curtain 66 will eliminate the vortical characteristics of the flow in the critical region 82. Through the elimination of the vortical flow, successful coating of sensitometric photographic products can be produced which are free of the air induced irregular streaks. It has further been found that the quantity of air removed from the critical region 82 can be greater than the amount of air entrained on the backside of the free-falling curtain 66 without inducing streaks on the falling liquid curtain 66. However, beyond a certain level of excess air, random streaks resumed. Based upon computer simulations, it is believed that when a recirculating flow pattern is present, the air pressure profile along the curtain has some regions in which the pressure gradient is adverse, that is, the air pressure on the curtain is increasing in the direction of fall. The results of the computer simulation are shown qualitatively in FIG. 6 which plots pressure versus vertical position on the free-falling curtain 66. The presence of an adverse pressure gradient along any boundary has been known to provide the necessary conditions for amplification of disturbances in the flow. As a result, disturbances in the flow may be amplified to levels at which they become damaging to the free-falling curtain 66. In a similar manner and again based upon a computer simulation, when an excess volume of air beyond an optimal threshold is removed, a region of adverse air pressure gradient is also generated. The results of the computer simulation are shown qualitatively in FIG. 7. Within the optimal range of air removal, however, the computer simulation shows no adverse pressure gradient present along the curtain boundary outside of the local region affected by the web boundary layer. The results of the computer simulation are shown qualitatively in FIG. 8.

In the practice of the present invention the boundary-layer air entrained on the web 28 and the boundary-layer air entrained on the back side of the curtain 26 are both prevented from establishing a recirculation pattern. For the boundary-layer air entrained on the web 28, the effect of boundary-layer air can be nullified by using Equation (1) below to set the minimum volume of air to be removed by the boundary-layer air removal system 81 through manifold 74.

$$Q_1=BWSh \tag{1}$$

where S is the speed of web 28, h is the gap between the tip 89, 109 and the web 28, W is the width (which generally equals the length of tip 89, 109) of the air shield 72, 98, $Q_1$ is the minimum air flow removal rate through manifold 74 that will nullify the entrained air of web 28, and B is a changeable parameter that is dependent on several factors known to those skilled in the art. For example, if the boundary-layer thickness due to web motion is less than or equal to the tip to web gap spacing, or if the boundary-layer thickness is expected to substantially exceed the tip to web gap spacing, and at the same time, if the flow pattern in the region between the shield and the web is substantially laminar, then the minimum air flow removal rate through manifold 74 for nullifying the entrained air is approximated with a value of B=1 thus yielding Equation (2) below:

$$Q_1=WSh \tag{2}$$

On the other hand, if the boundary-layer thickness is expected to substantially exceed the tip to web gap spacing and if the flow pattern in the region between the shield and the web is expected to be of orifice type, then the minimum air flow removal rate through manifold 74 for nullifying the entrained air is obtained by setting B=2 thereby yielding equation 3 below:

$$Q_1=2WSh \tag{3}$$

The boundary-layer thickness can be obtained from mathematical equations well known in the art for such purpose. B need not be limited to a value of 1 or 2, as combinations of both types of flow may exist simultaneously in the same curtain coating setup.

For the boundary-layer air entrained on the back side of the curtain 66, the effect of boundary-layer air can be nullified by using Equation (4) below to set the flow rate of air to be removed by the boundary-layer air removal system 81 through manifold 78:

$$Q_2\approx 0.3AWl^{0.75}g^{0.25}v^{0.5} \tag{4}$$

where $Q_2$ is the flow rate of air to be removed through manifold 78, l is the length of the liquid curtain 66, W is the width (which generally equals the length of tip 89, 109) of air shield 72, 98, g is the acceleration due to gravity, v is the kinematic viscosity of air, and A is an adjustable parameter. For the critical region 82 to be free of air flow recirculation, the value of A can be in the range of from about 4.0 to about 19.0. For optimum operation, A should be in the range of from about 4.5 to about 5.0. The equation (4) assumes that air supply and air exhaust have been balanced to and from the coating apparatus.

Those skilled in the art should recognize that the method and apparatus of the present invention can be practiced with or without enclosure 52. If the present invention is practiced with an enclosure 52, it is preferable to use a forced air supply system to supply replenishing air to enclosure 52.

From the foregoing, it will be seen that this invention is one well adapted to obtain all of the ends and objects hereinabove set forth together with other advantages which are apparent and which are inherent to the invention.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth and shown in the accompanying drawings is to be interpreted as illustrative and not in a limiting sense.

What is claimed is:

1. A method for preventing vortical flow in a curtain coating apparatus wherein a free-falling curtain of coating liquid is delivered to a moving substrate, said air removal system comprising the steps of:

(a) evacuating boundary-layer air entrained on the moving substrate with a first intake slot; and (b) evacuating boundary-layer air entrained on a back side of the free-falling curtain with a second intake slot.

2. A method for preventing vortical flow in a curtain coating apparatus including an air shield wherein a free-falling curtain of coating liquid is delivered to a moving substrate, said air removal system comprising the steps of:

(a) evacuating boundary-layer air entrained on the moving substrate; and (b) evacuating an amount of boundary-layer air $Q_2$ entrained on a back side of the free-falling curtain wherein the amount can be determined using the equation $$Q_2 \approx 0.3AWl^{0.75}g^{0.25}v^{0.5}$$

where $Q_2$ is the flow rate of boundary-layer air to be removed, l is the length of the free-falling curtain, W is the width of air shield, g is the acceleration due to gravity, v is the kinematic viscosity of air, and A is an adjustable parameter in the range of from about 4.0 to about 19.0.

3. An air removal system for preventing vortical air flow in a curtain coating apparatus including an air shield wherein a free-falling curtain of coating liquid is delivered to a moving substrate, said air removal system comprising:

(a) a first intake slot proximate to the moving substrate;

(b) a first vacuum source communicating with said first intake slot, said first intake slot adapted to remove a first boundary-layer of air entrained on the moving substrate; and (c) a second intake slot proximate to said first intake slot and adapted to remove a second boundary-layer of air entrained on a backside of the free-falling curtain.

4. An air removal system as recited in claim 3 wherein:

an amount of air $Q_2$ removed through said second intake slot can be determined using the equation $$Q_2 \approx 0.3AWl^{0.75}g^{0.25}v^{0.5}$$

where $Q_2$ is the flow rate of the second boundary-layer air to be removed, l is the length of the free-falling curtain, W is the width of air shield, g is the acceleration due to gravity, v is the kinematic viscosity of air, and A is an adjustable parameter in the range of from about 4.0 to about 19.0.

5. An air removal system for removing air from a curtain coating apparatus wherein a free-falling curtain of coating liquid is delivered to a moving substrate, said air removal system comprising:

(a) a first intake slot proximate to the moving substrate;

(b) a first vacuum source communicating with said first intake slot, said first intake slot adapted to remove a first boundary-layer of air entrained on the moving substrate; and (c) a second intake slot proximate to said first intake slot and adapted to remove a second boundary-layer of air entrained on a backside of the free-falling curtain.

6. An air removal system as recited in claim 5 further comprising:

a second vacuum source communicating with said second intake slot.

7. An air removal system as recited in claim 5 further comprising:

(a) a manifold;

(b) a first control valve connecting said first intake slot to said manifold; and (c) a second control valve connecting said second intake slot to said manifold.

8. An air removal system as recited in claim 5 wherein:

said first intake slot includes a first tip and said second intake slot includes a second tip, said second tip residing further from said curtain than said first tip.

9. An air removal system as recited in claim 8 wherein:

said second tip resides at a minimum distance of about one inch from said curtain.

10. An air removal system as recited in claim 9 wherein:

said second tip resides at a maximum distance from said curtain wherein said second tip is aligned with a rear wall of said coating hopper.

11. An air removal system as recited in claim 5 wherein:

a tip of said second intake slot resides in a critical zone defined by the free-falling curtain, a bottom surface and a front surface of said coating hopper, a portion of the moving substrate supported on said roll and a top surface of an air shield residing between said roll and said coating hopper.

12. An air removal system as recited in claim 5 further comprising:

an air shield positioned above said second intake slot.

13. A curtain coating apparatus for coating a moving substrate comprising:

(a) a coating hopper;

(b) a rotatable roll for supporting said moving substrate, said coating hopper delivering a free-falling curtain to said moving substrate while said moving substrate is supported on said roll;

(c) a first means for removing a first boundary-layer of air entrained on said moving substrate; and (d) a second means for removing a second boundary-layer of air entrained on a backside of said free-falling curtain.

14. A curtain coating apparatus as recited in claim 13 further comprising:

an enclosure, said coating hopper residing within said enclosure.

15. A curtain coating apparatus as recited in claim 13 wherein said means for removing said first boundary-layer of air comprises:

(a) a first intake slot proximate to the moving substrate;

(b) a first vacuum source communicating with said first intake slot, said first intake slot adapted to remove a first boundary-layer of air entrained on the moving substrate.

16. A curtain coating apparatus as recited in claim 15 wherein said means for removing said second boundary-layer of air comprises:

a second intake slot proximate to said first intake slot.

17. A curtain coating apparatus as recited in claim 16 further comprising:

a second vacuum source communicating with said second intake slot.

18. A curtain coating apparatus as recited in claim 16 further comprising:

(a) a manifold;

(b) a first control valve connecting said first intake slot to said manifold; and (c) a second control valve connecting said second intake slot to said manifold.

19. A curtain coating apparatus as recited in claim 16 wherein:

a tip of said second intake slot resides in a critical zone defined by the free-falling curtain, a bottom surface and a front surface of said coating hopper, a portion of the moving substrate supported on said roll and a top surface of an air shield residing between said roll and said coating hopper.

20. An improved curtain coating apparatus as recited in claim 16 wherein:

said first intake slot includes a first tip and said second intake slot includes a second tip, said second tip residing further from said curtain than said first tip.

21. An improved curtain coating apparatus as recited in claim 20 wherein:

said second tip resides at a minimum distance of about one inch from said curtain.

22. An improved curtain coating apparatus as recited in claim 21 wherein:

said second tip resides at a maximum distance from said curtain wherein said second tip is aligned with a rear wall of said coating hopper.

23. An air removal system in combination with a curtain coating apparatus coating a moving substrate, said combination comprising:

(a) a coating hopper;

(b) a rotatably supported roll for supporting said moving substrate, said coating hopper delivering a free-falling curtain to said moving substrate while said moving substrate is supported on said roll;

(c) means for removing a first boundary-layer of air entrained on said moving substrate; and (d) means for removing a second boundary-layer of air entrained on a backside of said free-falling curtain, said means for removing said second boundary-layer positioned further from said free-falling curtain than said means for removing said first boundary-layer.

* * * * *